US007347460B2

(12) United States Patent
Ala

(10) Patent No.: US 7,347,460 B2
(45) Date of Patent: Mar. 25, 2008

(54) LATCH DEVICE FOR A DOOR OF AN ELECTRIC HOUSEHOLD APPLIANCE IN PARTICULAR A DISHWASHING MACHINE

(75) Inventor: Gian Battista Ala, Volpiano (IT)

(73) Assignee: ITW Industrial Components S.R.L., Milan (IT)

( * ) Notice: Subject to any disclaimer, the term of this patent is extended or adjusted under 35 U.S.C. 154(b) by 180 days.

(21) Appl. No.: 11/190,891

(22) Filed: Jul. 28, 2005

(65) Prior Publication Data

US 2006/0033346 A1 Feb. 16, 2006

(30) Foreign Application Priority Data

Jul. 30, 2004 (IT) ..... TO2004A0534

(51) Int. Cl.
*E05C 3/06* (2006.01)

(52) U.S. Cl. ..... 292/216; 292/DIG. 37

(58) Field of Classification Search ..... 292/216, 292/DIG. 56, 111, 312, 31 A, DIG. 37
See application file for complete search history.

(56) References Cited

U.S. PATENT DOCUMENTS 3,260,813 A * 7/1966 Dargene ..... 200/61.64
4,177,656 A * 12/1979 Davis ..... 70/84
5,356,186 A * 10/1994 Favaro ..... 292/216
6,048,001 A * 4/2000 Miller et al. ..... 292/198
6,390,518 B1 * 5/2002 Elick ..... 292/216
6,419,286 B1 * 7/2002 Szablewski ..... 292/216

FOREIGN PATENT DOCUMENTS

EP 0518147 12/1992

* cited by examiner

*Primary Examiner*—Gary Estremsky

(57) ABSTRACT

A latch device for a swing door of an electric household appliance, includes a support fixable to the door; a fork-shaped latch member fitted in rotary manner to the support to cooperate, in use, with a fixed striker of the appliance; and a control button fitted to the support to slide in opposition to a first elastic element. The latch member is movable, in opposition to a second elastic element on the support, between a first operating position, in which it does not engage the striker, and a second operating position, in which it does engage the striker. A contact member is fitted to the support to slide parallel to the control button in opposition to a third elastic element, and operatively interposed between the control button and the latch member to selectively lock the latch member in the second operating position, and to be selectively locked by the latch member when the latch member is in the first operating position.

16 Claims, 2 Drawing Sheets

LATCH DEVICE FOR A DOOR OF AN ELECTRIC HOUSEHOLD APPLIANCE IN PARTICULAR A DISHWASHING MACHINE

RELATED APPLICATIONS

The present application is based on, and claims priority from, Italian Application Number TO2004A 000534, filed Jul. 30, 2004, the disclosure of which is hereby incorporated by reference herein in its entirety.

The present invention relates to a latch device for a door of an electric household appliance, and in particular to a latch device for a swing door of a dishwashing machine, by which the door can be opened by simply pressing a control button.

BACKGROUND OF THE INVENTION

As is known, a work compartment of an electric household appliance, such as a dishwashing compartment, is closed, when the appliance is running, by a normally hinged door. The door of a dishwashing machine is normally mounted to swing vertically, and the user must be able to open the door during the wash cycle to load more dishes (even only for rinsing) or detergent additives, or even simply to check on progress of the washing cycle. In which case, the wash cycle must be stopped before the door can be opened, to prevent splashing, and then started again once the door is closed.

Since the door must be closed fluidtight to prevent leakage, it is normally equipped with a fork/striker type latch device to ensure sufficient pressure is exerted on the peripheral door seal when the door is closed.

Since a certain amount of force must therefore be applied by the user on the door to open it, the door must normally be equipped with a handle or other gripping devices, which are unsightly and bulky. Dishwashing machines are available, in which the door is pressed open/shut (push-push type), and which therefore have no handles. The latch devices required in this case, however, are complex, expensive, and not always reliable (on account of the necessity to ensure fast stoppage of the wash cycle).

A demand therefore exists for a latch device which is safe and dependable, and which can be handlefree controlled by the user, e.g. by simply pressing a button.

Such a system, for a washing machine, is described in Zanussi Patent EP 0518147, in which, however, the door is opened by means of a servomechanism controlled electrically by the pushbutton. Such a solution is obviously unsatisfactory, both in terms of the high cost involved and the impossibility of opening the door in the event of power failure.

SUMMARY OF THE INVENTION

It is an object of the present invention to eliminate the drawbacks of the aforementioned known devices by providing a latch device enabling the user to open the door of the appliance without a handle, by simply pressing a control button, and which at the same time permits low-cost manufacture and assembly, compactness, and a high degree of reliability of both the device itself and the appliance as a whole.

According to the present invention, there is provided a latch device for a door of an electric household appliance, as claimed in the attached claims.

More specifically, the latch device comprises a support fixable to the door; a fork-shaped latch member fitted in rotary manner to the support in such a position as to cooperate, in use, with a fixed striker fitted to a casing of the appliance; and a control button fitted to the support to slide in opposition to first elastic means, so as to be positioned, in use, at a front surface of the door. The latch member is movable, in opposition to second elastic means on the support, between a first operating position, in which it does not engage the striker, and a second operating position, in which it engages the striker. According to one aspect of the invention, a contact member is fitted to the support to slide parallel to the control button, and is operatively interposed between the control button and the latch member to selectively lock the latch member in the second operating position, and to be selectively locked by the latch member when the latch member is in the first operating position.

The above device advantageously also comprises electric control means, e.g. a microswitch, for controlling the appliance, and which are fitted to the support and activated by the contact member, e.g. to stop the wash cycle in time. The contact member is movable, in opposition to third elastic means, between a first position, in which it rests against a rear end of said control button and does not activate the electric control means, and a second position, in which it does activate the electric control means.

More specifically, the latch member and the contact member have first and second corresponding contact means, which respectively lock the latch member selectively in said second operating position when said contact member is in said first position, and lock the contact member selectively in said second position when said latch member is in said first operating position.

The control button thus remains in a rest position, clearly visible and easily accessible on the door, e.g. flush with or slightly extracted with respect to the front surface of the door, while the latch member may remain indifferently in either of the operating positions until it is moved, either by the control button being pressed (with the door closed) or by cooperating with the striker as the door is closed.

At the same time, when the door is closed, the microswitch is not activated, and the latch member engages the striker to keep the door closed tightly enough to ensure perfect fluidtight sealing by the seals. In this position, the contact member, which is located behind the control button and beneath the latch member, cooperates with the latch member to prevent it rotating in opposition to the second elastic means.

To release and open the door, the user simply presses the control button, which, in opposition to the first elastic means, moves from the rest position to a withdrawn position, in which a rear end of the control button intercepts the contact member. Travel of the control button into the withdrawn position therefore moves the contact member, in opposition to the third elastic means, towards the microswitch, which is thus activated to stop the wash cycle while the door is still closed and the latch member still engages the striker.

Movement of the contact member, however, also releases the contact member from the latch member, which, once released, is restored by the second elastic means to the first operating position. As it is released, the latch member is pushed against the striker by the second elastic means, and intercepts the contact member on the side facing the control button, so that the door is swung into a half-open position, and the contact member is locked against the microswitch.

At this point, the door can be fully opened by gripping the half-open edge, whereas, even with the control button released and restored to the rest position, the contact member is prevented from returning to the start position.

To lock the door, it is simply pushed shut. Which movement pushes the latch member against the striker, so that the latch member rotates and engages the striker. At the same time, rotation of the latch member, in opposition to the second elastic means, releases the contact member, which is pushed by the third elastic means into the start position, resting against the control button, thus releasing pressure on the microswitch so that the wash cycle can be started again.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
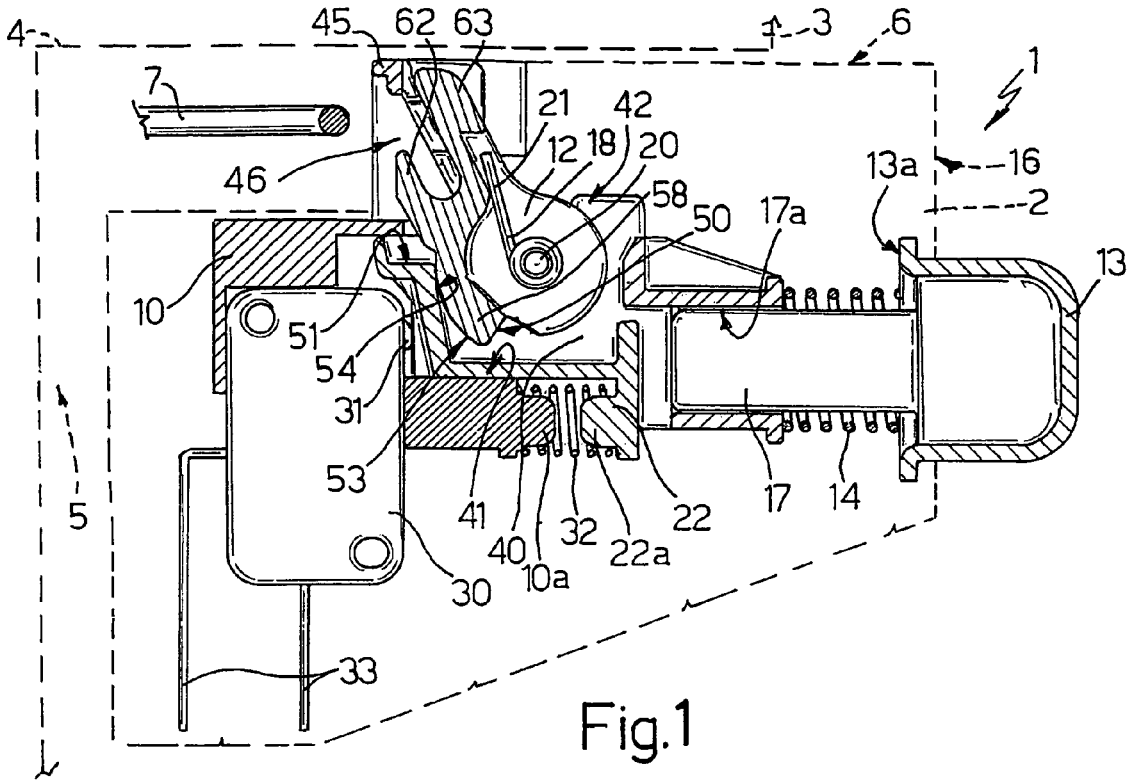
FIG. 1 shows a schematic longitudinal section of a latch device in accordance with the invention, in a release configuration, and fitted to the top edge of an electric household appliance swing door in a half-open position.
Figure 3:
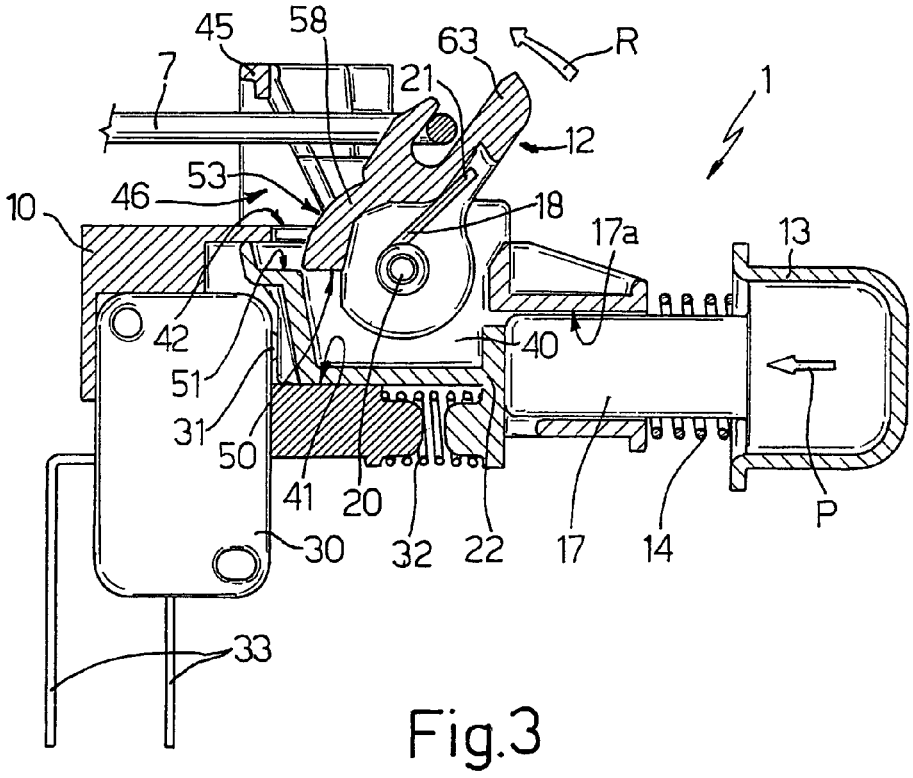
FIG. 3 shows the FIG. 1 device with the door closed but in a release configuration.
Figure 2:
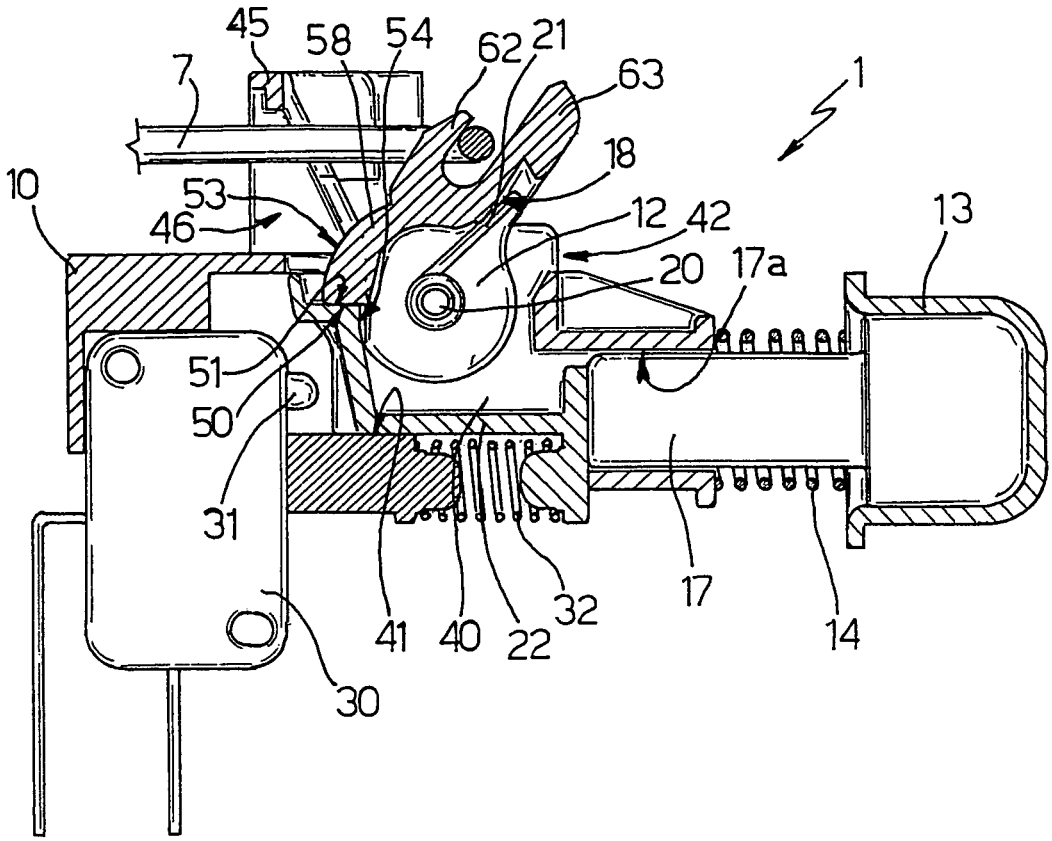
FIG. 2 shows the FIG. 1 device in a configuration corresponding, in use, to a closed position of the door.

Number 1 in FIGS. 1 to 3 indicates as a whole a latch device for a door 2 of an electric household appliance 3, in particular a swing door 2 of a dishwashing machine 3, of which the top portion of a casing 4 defining a door opening 5 is shown by a dash line.

In the non-limiting embodiment shown, device 1 is fitted, in use, to a top edge 6 of door 2, facing a fixed known striker 7 fixed integrally to casing 4 at the top of door opening 5.

Device 1 comprises a support 10 fixable to door 2; a substantially known fork-shaped latch member 12 fitted in rotary manner to support 10 in such a position as to cooperate, in use, with striker 7; and a control button 13 fitted to support 10 to slide in opposition to first elastic means 14, so as to be positioned, in use, at a front outer surface 16 of door 2. In the example shown, a rear end 17 of button 13 is guided and slides inside a through seat 17*a* of support 10 facing surface 16 in use, and elastic means 14 comprise a helical spring gripped between a seating surface 13*a* of button 13 (FIG. 1) and seat 17*a*.

Latch member 12 is movable, in opposition to second elastic means 18, between a first operating position (FIG. 1), in which it does not engage striker 7, and a second operating position (FIG. 2), in which it does engage striker 7.

More specifically, latch member 12 is supported idly on a pin 20 defining its fulcrum and in turn fitted integrally to support 10; and elastic means 18 comprise a known torsion spring wound about pin 20 and having an arm 21 which acts directly on latch member 12, on the opposite side to button 13.

Device 1 also comprises a contact member 22 fitted to support 10 to slide parallel to control button 13, and which, according to the invention, is operatively interposed between control button 13 and latch member 12 to selectively lock latch member 12 in the second operating position (FIG. 2), and to be selectively locked by latch member 12 when latch member 12 is in the first operating position (FIG. 1).

In the non-limiting example shown for a dishwashing machine, device 1 also comprises known electric control means 30 for controlling the appliance, and which are fitted to support 10 and activated by contact member 22.

Contact member 22 is fitted to support 10 to move—in opposition to third elastic means 32 comprising a helical spring gripped between a seating member 22*a* of contact member 22 and a seating member 10*a* of support 10 (FIG. 1)—between a first position (FIG. 2), in which it rests against rear end 17 of control button 13 and does not activate electric control means 30, and a second position (FIGS. 1 and 3), in which it does activate electric control means 30.

In the example shown, the electric control means comprise a normally-closed microswitch 30 having a movable button 31 (shown schematically) and connectable in known manner to the electric circuit of dishwashing machine 3 by faston connectors 33 (FIG. 1).

In the example shown, contact member 22 is in the form of a cup-shaped body, is housed inside a seat 40 in support 10, between control button 13 and microswitch 30, slides on a bottom wall 41 of seat 40, and is positioned with its concavity facing an opening 42 of seat 40, where fulcrum 20 of latch member 12 is located.

On the opposite side to control button 13, at opening 42, support 10 has a protection member 45 for protecting latch member 12 and having an opening 46 through which to receive striker 7 in use (FIGS. 2, 3). Member 45 also serves to assemble support 10 in known manner to door 2.

According to one aspect of the invention, latch member 12 and contact member 22 have first and second corresponding contact means, which respectively lock latch member 12 selectively in the second operating position when contact member 22 is in the first position (FIG. 2), and lock contact member 22 selectively in the second position (FIG. 1) when latch member 12 is in the first operating position.

The first corresponding contact means comprise a substantially flat first contact surface 50 located on latch member 12 and projecting substantially radially with respect to fulcrum 20; and a substantially flat second contact surface 51 located on contact member 22, facing opening 42, extending substantially parallel to the slide direction of control button 13 and contact member 22, and lying substantially in a plane through or in close proximity to fulcrum 20.

The second corresponding contact means comprise a substantially cylindrical third contact surface 53 located on the outer circumference of latch member 12, on the opposite side to control button 13; and a substantially flat fourth contact surface 54 located on contact member 22, adjacent to second contact surface 51, and extending crosswise to the slide direction of control button 13 and contact member 22—in the example shown, at 90° to surface 51 to form an edge portion of the concavity of contact member 22.

First contact surface 50 and third contact surface 53 are formed on a radial projection 58 of latch member 12.

In the FIG. 2 position, door 2 is closed and rests in known fluidtight manner against door opening 5; striker 7 is engaged in known manner by fork-shaped latch member 12, and in particular by a tooth 62 of the latch member; and button 31 is not pressed by contact member 22, which is held resting axially against rear end 17 of button 13 by the preloaded spring 32. In this position, latch member 12 is prevented from rotating to release striker 7, by surface 50 resting on surface 51 of contact member 22 underneath, precisely on a level with the centre of fulcrum 20, so that dishwashing machine 3 can therefore operate normally.

To open door 2, the user simply presses button 13 in the direction of arrow P (FIG. 3) to overcome the resistance of springs 14 and 32 and slide contact member 22, by means of end 17, into the FIG. 3 position. This sliding movement also produces a relative sliding movement of surfaces 50 and 51 to detach surface 51 completely from surface 50. At the same time, member 22 comes to rest against and presses button 31 into a withdrawn position, thus activating microswitch 30, which therefore stops the wash cycle and dishwashing machine 3. In the FIG. 3 release position, door 2 is still firmly closed, but dishwashing machine 3 is already off.

At this point, latch member 12, no longer retained by contact member 22 underneath, is rotated by spring 18, in the direction of arrow R (FIG. 3), into the FIG. 1 position. As it rotates, member 12 releases tooth 62 from striker 7 in known manner, and pushes against striker 7 with a corresponding projecting radial end 63 opposite and facing tooth 62.

Striker 7 being fixed, the resulting reaction is transmitted to door 2, which is detached from door opening 5 and moved into the FIG. 1 position, in which edge 6 may be gripped easily by the user to open door 2 completely with no handle required.

As latch member 12 completes its rotation into the FIG. 1 position, surface 53 of latch member 12 cooperates with surface 54 to prevent spring 32 from restoring contact member 22 to the start position, even when button 13 is released by the user and restored to the FIG. 2 start position by spring 14, so that end 17 releases member 22. Microswitch 30 therefore remains activated, even with door 2 open.

Door 2 is closed by simply pushing on surface 16 to push door 2 into a position resting against door opening 5. When so doing, end 63 of latch member 12, which is in the FIG. 1 position, cooperates with striker 7, and the closing movement of door 2 rotates the latch member about fulcrum 20—in opposition to spring 18, which is thus loaded elastically—into the FIG. 2 closed position.

As the latch member rotates as described above, surface 53 releases surface 54, so that contact member 22 can also be restored to the FIG. 2 position, and dishwashing machine 3 started again by release of microswitch 30.

The invention claimed is:

1. A latch device for a door of an appliance, said latch device comprising:

a support fixable to the door;

a latch member rotatably attached to the support and adapted to cooperate, in use, with a fixed striker fitted to a casing of the appliance; and a control button moveably supported by the support and adapted to be positioned, in use, at a front surface of the door;

the latch member being rotatable between a unlatched position, in which the latch member is not latchable with the striker, and a latched position, in which the latch member is latchable with the striker;

the device further comprising a contact member attached to the support to be moveable between first and second positions, and operatively interposed between the control button and the latch member to selectively lock the latch member when the latch member is in the latched position and the contact member is in the first position, and to be selectively locked by the latch member when the latch member is in the unlatched position and the contact member is in the second position;

wherein when said latch member is in the latched position and said contact member is in the first position, said contact member engages said latch member, prevents said latch member from moving to the unlatched position, and is moveable by a movement of said control button to the second position in which said contact member disengages said latch member and allows said latch member to be moveable to the unlatched position; and when said latch member is in the unlatched position and said contact member is in the second position, said latch member engages said contact member, prevents said contact member from moving to the first position, and is moveable to the latched position in which said latch member disengages said contact member and allows said contact member to be moveable to the first position;

said device further comprising an electric control element for controlling the appliance, said electric control element being attached to the support and adapted to be activated by the contact member;

wherein the contact member, in the first position, rests against a rear end of said control button and does not activate the electric control element, and, in the second position, activates the electric control element; and wherein said latch member and said contact member have first and second pairs of corresponding contact elements, which are respectively engageable to lock said latch member selectively in said latched position when said contact member is in said first position, and lock said contact member selectively in said second position when said latch member is in said unlatched position.

2. A device as claimed in claim 1, wherein said electric control element comprises a normally-closed microswitch.

3. A device as claimed in claim 1, wherein said first pair of corresponding contact elements comprise a first contact surface located on the latch member and projecting substantially radially with respect to a fulcrum of the latch member; and a second contact surface located on the contact member, extending substantially parallel to a path along which the contact member is moveable between the first and second positions, and lying substantially in a plane through said fulcrum of the latch member.

4. A device as claimed in claim 3, wherein said second pair of corresponding contact elements comprise a third contact surface located on the outer circumference of the latch member, on the opposite side to the control button; and a fourth contact surface located on the contact member, adjacent to said second contact surface, and extending crosswise to the path of the contact member.

5. A device as claimed in claim 4, wherein said first contact surface and said third contact surface are formed on a radial projection of said latch member.

6. A latch device for a door of an electric household appliance, said device comprising:

a support fixable to the door;

a fork-shaped latch member fitted in rotary manner to the support in such a position as to cooperate, in use, with a fixed striker fitted to a casing of the appliance; and a control button fitted to the support to be slidable in opposition to a first elastic element, so as to be positioned, in use, at a front surface of the door;

the latch member being movable, in opposition to a second elastic element on the support, between a first operating position, in which said latch member does not engage the striker, and a second operating position, in which said latch member does engage the striker;

wherein the device further comprises:

a contact member fitted to the support to be slidable parallel to the control button, and operatively interposed between the control button and the latch member to selectively lock the latch member in the second operating position, and to be selectively locked by the latch member when the latch member is in the first operating position; and an electric control element for controlling the appliance, said electric control element being fitted to the support and adapted to be activated by the contact member;

the contact member is movable, in opposition to a third elastic element, between a first position, in which said contact member rests against a rear end of said control button and does not activate the electric control element, and a second position, in which said contact member does activate the electric control element; and said contact member is housed in a seat inside the support, between said control button and said electric control element, slidable on a bottom wall of the seat, and positioned facing an opening of the seat, where a fulcrum of said latch member is located.

7. A device as claimed in claim 6, wherein on the opposite side to the control button and at said opening, said support has a protection member for protecting the latch member and having an opening through which said striker is received in use.

8. A latch device for a door of an appliance, said latch device comprising:

a support fixable to the door;

a latch member rotatably attached to the support and adapted to cooperate, in use, with a fixed striker fitted to a casing of the appliance; and a control button moveably supported by the support and adapted to be positioned, in use, at a front surface of the door;

the latch member being rotatable between a unlatched position, in which the latch member is not latchable with the striker, and a latched position, in which the latch member is latchable with the striker;

the device further comprising a contact member attached to the support to be moveable between first and second positions, and operatively interposed between the control button and the latch member to selectively lock the latch member when the latch member is in the latched position and the contact member is in the first position, and to be selectively locked by the latch member when the latch member is in the unlatched position and the contact member is in the second position;

wherein when said latch member is in the latched position and said contact member is in the first position, said contact member engages said latch member, prevents said latch member from moving to the unlatched position, and is moveable by a movement of said control button to the second position in which said contact member disengages said latch member and allows said latch member to be moveable to the unlatched position; and when said latch member is in the unlatched position and said contact member is in the second position, said latch member engages said contact member, prevents said contact member from moving to the first position, and is moveable to the latched position in which said latch member disengages said contact member and allows said contact member to be moveable to the first position;

said device further comprising:

a first elastic element biasing said latch member towards the unlatched position;

a second elastic element biasing said contact member towards the first position; and a third elastic element biasing said control button away from said contact member.

9. A device as claimed in claim 8, further comprising an electric control element for controlling the appliance, said electric control element being attached to the support and adapted to be activated by the contact member;

in the first position, the contact member rests under biasing forces of said second elastic element against a rear end of said control button and does not activate the electric control element, and, in the second position, the contact member activates the electric control element.

10. A device as claimed in claim 9, wherein said electric control element comprises a normally-closed microswitch.

11. A device as claimed in claim 9, wherein said latch member and said contact member have first and second pairs of corresponding contact elements, which are respectively engageable to lock said latch member selectively in said latched position when said contact member is in said first position, and lock said contact member selectively in said second position when said latch member is in said unlatched position.

12. A device as claimed in claim 11, wherein said first pair of corresponding contact elements comprise a first contact surface located on the latch member and projecting substantially radially with respect to a fulcrum of the latch member; and a second contact surface located on the contact member, extending substantially parallel to a path along which the contact member is moveable between the first and second positions, and lying substantially in a plane through said fulcrum of the latch member.

13. A device as claimed in claim 12, wherein said second pair of corresponding contact elements comprise a third contact surface located on the outer circumference of the latch member, on the opposite side to the control button; and a fourth contact surface located on the contact member, adjacent to said second contact surface, and extending crosswise to the path of the contact member.

14. A device as claimed in claim 13, wherein said first contact surface and said third contact surface are formed on a radial projection of said latch member.

15. A latch device for a door of an appliance, said latch device comprising:

a support fixable to the door;

a latch member rotatably attached to the support and adapted to cooperate, in use, with a fixed striker fitted to a casing of the appliance; and a control button moveably supported by the support and adapted to be positioned, in use, at a front surface of the door;

the latch member being rotatable between a unlatched position, in which the latch member is not latchable with the striker, and a latched position, in which the latch member is latchable with the striker;

the device further comprising a contact member attached to the support to be moveable between first and second positions, and operatively interposed between the control button and the latch member to selectively lock the latch member when the latch member is in the latched position and the contact member is in the first position, and to be selectively locked by the latch member when the latch member is in the unlatched position and the contact member is in the second position;

wherein when said latch member is in the latched position and said contact member is in the first position, said contact member engages said latch member, prevents said latch member from moving to the unlatched position, and is moveable by a movement of said control button to the second position in which said contact member disengages said latch member and allows said latch member to be moveable to the unlatched position; and when said latch member is in the unlatched position and said contact member is in the second position, said latch member engages said contact member, prevents said contact member from moving to the first position, and is moveable to the latched position in which said latch member disengages said contact member and allows said contact member to be moveable to the first position;

said contact member is housed in a seat inside the support, between said control button and said electric control element, slidable on a bottom wall of the seat, and positioned facing an opening of the seat, where a fulcrum of said latch member is located.

16. A device as claimed in claim 15, wherein on the opposite side to the control button and at said opening, said support has a protection member for protecting the latch member and having an opening though which said striker is received in use.

* * * * *